US005584767A

United States Patent [19]

Picchietti et al.

[11] Patent Number: 5,584,767

[45] Date of Patent: Dec. 17, 1996

[54] BOWLING BALL FINGER INSERT HAVING A WEAR INDICATOR

[75] Inventors: Remo N. Picchietti, Bannockburn; Mike Sledz, Vernon Hills, both of Ill.

[73] Assignee: Columbia Industries, Inc., San Antonio, Tex.

[21] Appl. No.: 475,625

[22] Filed: Jun. 7, 1995

[51] Int. Cl.[6] ..... A63B 43/02

[52] U.S. Cl. ..... 473/130; 273/DIG. 5

[58] Field of Search ..... 473/130, 127, 473/128, 129, DIG. 5

[56] References Cited

U.S. PATENT DOCUMENTS

| | | | |
|---|---|---|---|
| 712,192 | 10/1902 | Immen | 473/130 |
| 1,021,490 | 3/1912 | Scully | 473/130 |
| 2,482,190 | 9/1949 | Kramer | 473/130 |
| 3,001,793 | 9/1961 | Insetta | 473/130 |
| 3,261,388 | 7/1966 | Kovac et al. . | |
| 3,266,804 | 8/1966 | Carter | 473/130 |
| 3,271,031 | 9/1966 | Mitchell | 473/130 |
| 3,342,488 | 9/1967 | Novatnak | 473/130 |
| 4,358,112 | 11/1982 | Straborny | 473/130 |
| 4,416,452 | 11/1983 | Heimbigner | 473/130 |
| 4,977,345 | 12/1990 | Toperzer | 310/242 |
| 4,982,767 | 1/1991 | Pezzoli et al. | 139/449 |
| 5,002,277 | 3/1991 | Ontko | 473/130 |
| 5,118,106 | 6/1992 | Goldman | 473/130 |
| 5,123,644 | 6/1992 | Bernhardt | 473/130 |

OTHER PUBLICATIONS

Pro–Grip Bowling Accessories Brochure, Pro–Grip Division, DBA Products Co., Inc., Lake Bluff, IL 60044, pp. 3–5.

*Primary Examiner*—George J. Marlo

*Attorney, Agent, or Firm*—Leydig, Voit & Mayer, Ltd.

[57] ABSTRACT

A finger insert having a wear indicator and adapted for installation along the wear surface in a finger hole of a bowling ball. The insert is a composite structure formed of a polymeric material and has a primary layer of a first color and a secondary layer of a contrasting second color. When installed in the finger hole, the primary layer is disposed adjacent the bowler's finger. As the primary layer wears away as a result of repeated bowls, the contrasting second color of the secondary layer becomes visible to indicate that the finger insert has served its useful life and should be changed.

20 Claims, 2 Drawing Sheets

BOWLING BALL FINGER INSERT HAVING A WEAR INDICATOR

FIELD OF THE INVENTION

The invention relates generally to bowling balls, and more specifically to finger inserts for bowling balls.

BACKGROUND OF THE INVENTION

Finger inserts for bowling balls are widely known and used in the bowling industry, millions being sold each year. Finger inserts are often secured to the inside of the finger hole to vary the size and/or texture of the hole. Such inserts are generally used to control the feel or control of the ball. Additionally, such inserts may be used to provide added comfort or better control by, for example, providing added grip, lift, spin or ease of holding or release of the ball.

Finger inserts are generally either patch-type inserts or tubular type inserts. Patch type inserts, such as those disclosed in U.S. Pat. Nos. 3,266,804, 3,271,031 and 3,342,488 to Carter, Mitchell, and Novatnak, respectively, are typically secured along an axially extending section of the finger hole. Tubular type inserts are generally glued into finger holes that have been drilled to standard sizes, typically 1, 1⅛, or 1¼ inches in diameter.

Inserts may be provided in a variety of materials, hardnesses, and internal sizes, shapes, or surfaces. In addition to those patents identified above, examples of such insert designs are disclosed in the following U.S. Pat. Nos. 4,358,112; 4,416,452; 5,002,277; 5,118,106; and 5,123,644.

While bowling ball finger inserts are widely used, one problem frequently encountered is that they tend to wear out. Unfortunately, there is no way to readily know when a grip is no longer effective. As a result, in many instances, bowlers will use the grip far past its useful life.

OBJECTS OF THE INVENTION

It is a primary object of the invention to provide a bowling ball finger insert from which the owner may easily determine when the insert is no longer effective for its intended purpose. A more specific object of the invention is to provide an insert that includes a wear indicator or "telltale" that may be easily viewed by the user to alert the user as to when the insert should be replaced.

Another object of the invention is to provide an inexpensive bowling ball finger insert that may be easily and economically manufactured.

A further object of the invention is to provide a bowling ball finger insert that does not require any special equipment for installation.

An additional object of the invention is to provide a bowling ball finger insert that may be manufactured in a variety of hardnesses in order to provide a variety of feels.

Yet another object of the invention is to provide a bowling ball finger insert that may be manufactured in a variety of colors to provide inserts that are both aesthetically pleasing and may be color coded to, for example, correspond to a particular size and/or hardness and/or design.

BRIEF SUMMARY OF THE INVENTION

In accomplishing these and other objects of the invention, there is provided a bowling ball finger insert that includes a wear indicator or "telltale." The insert includes at least two layers of different colors. The primary layer, which presents the inside wear surface or surface disposed adjacent the user's finger in an unworn insert, is a first color, and the secondary layer, which is disposed between the primary layer and the finger hole of the bowling ball, is a second color.

When the finger insert is first installed in the finger hole in the bowling ball, the first color will be visible along the inside surface of the finger hole. However, with repeated bowling, the primary layer will wear through to the secondary layer to reveal the second color. Preferably, there is a high contrast between the first and second colors of the primary and secondary layers so that the bowler may readily perceive the second color as it is revealed by wearing through of the primary layer. The finger insert should be replaced before a specified area of the second color is visible.

These and other features and advantages of the invention will be more readily apparent upon reading the following description of a preferred exemplified embodiment of the invention and upon reference to the accompanying drawings wherein:

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DESCRIPTION OF THE PREFERRED EMBODIMENT

Figure 1:
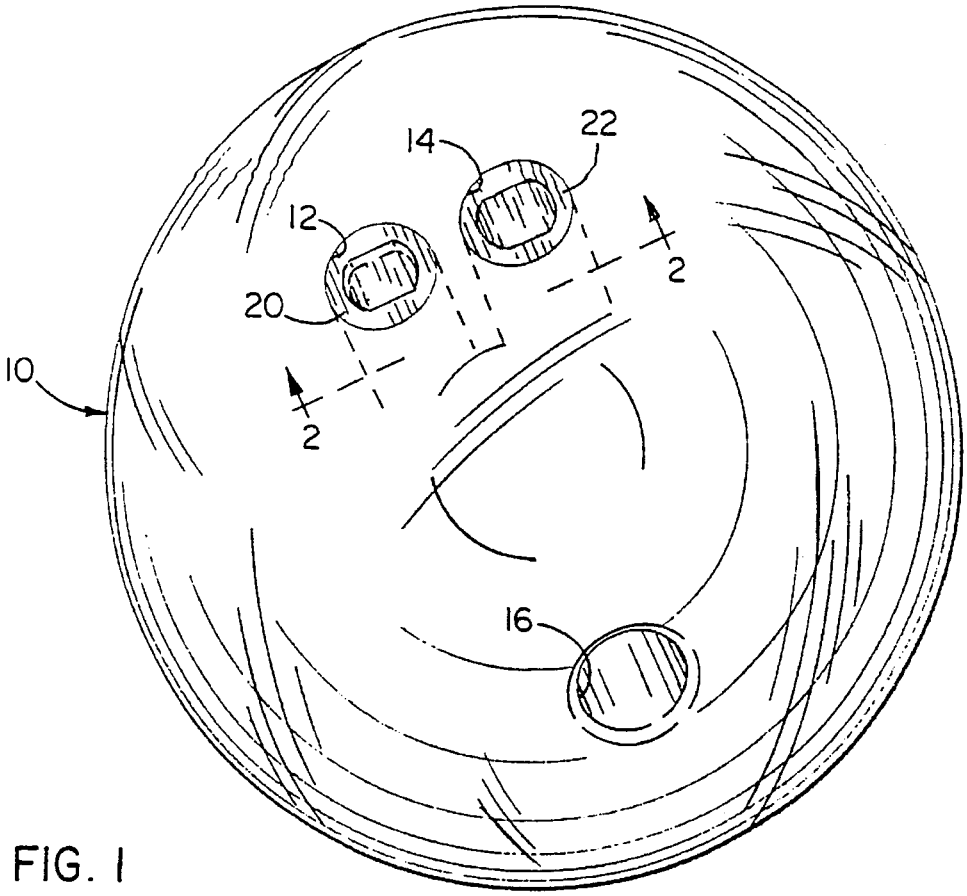
FIG. 1 is a perspective view of a bowling ball having two finger inserts installed, one of the finger inserts being constructed in accordance with teachings of the invention.

Turning now to FIG. 1, there is shown a bowling ball 10 having finger holes 12, 14 and a thumb hole 16. The finger holes 12, 14 are provided with finger inserts 20, 22. As shown in the FIG. 2, the finger holes 12, 14 are typically drilled to a standard depth, generally on the order of approximately two inches, although the depth may vary. The finger inserts 20, 22 are installed by gluing them into place in the holes 12, 14 using any adhesive which effectively bonds to the materials of both the finger insert 20, 22 and the bowling ball 10. Adhesives such as SUPER GLUE, or epoxy are particularly suitable.

Figure 2:
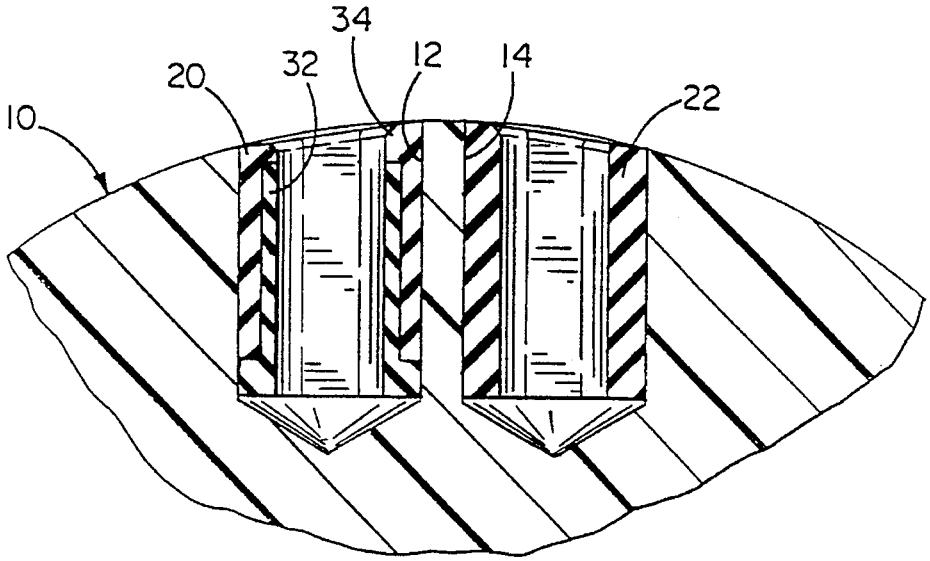
FIG. 2 is a fragmentary cross-sectional view of the bowling ball taken along their common diametrical plane, as indicated by line 2—2 in FIG. 1.
Figure 3A:
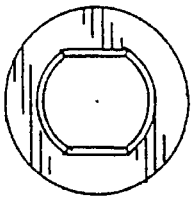
FIGS. 3A and 3B show top and side views, respectively, of a finger insert constructed in accordance with teachings of the invention.
Figure 3B:
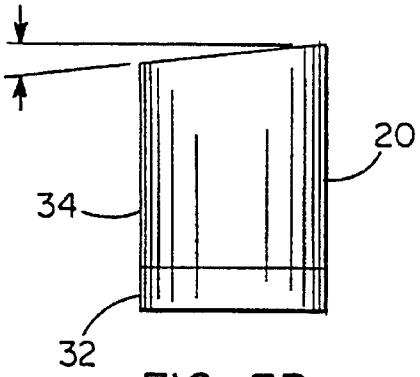

The finger inserts 20, 22 shown in FIG. 2 have a tubular shape. As shown in FIGS. 2 and 3B, the top surface of an insert 20 is typically disposed at a slight angle, which conforms generally to the shape of the surface of the bowling ball. This angle is typically on the order of 7.0° to 7½°, but may vary.

Figure 4:
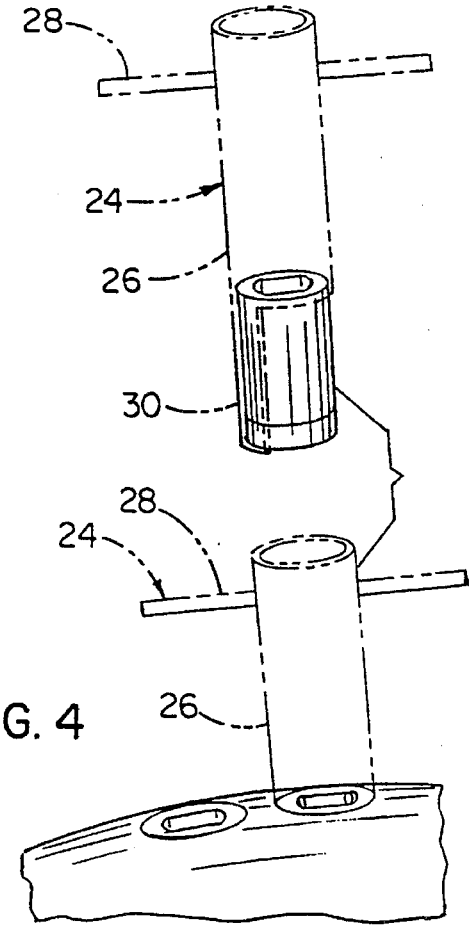
FIG. 4 is a perspective view of a finger insert as it is removed from a finger hole of a bowling ball, with a removal tool shown in phantom lines.

If a finger insert has been worn out or damaged, it may be removed and replaced using any appropriate means. For example, the insert may be drilled out or removed using a tool 24, such as is shown in phantom lines in FIG. 4. The tool 24 shown comprises a cylindrical blade portion 26 and a handle portion 28, which is disposed substantially normally to the axis of the cylindrical blade 26. The end 30 of the cylindrical blade 26 which is opposite the handle presents a sharp edge which may be used to cut the finger insert 20, 22 away from the finger hole 12, 14 of the bowling ball 10. After the finger insert is cut from the bowling ball 10, the inside surface of the finger hole may be cleaned and prepared by any appropriate method. Typically, course sandpaper is used to remove any material remaining adhered to the ball wall that defines the finger hole. A solvent such as mineral spirits, methylene chloride, MEX or others is then used to prepare the inside surface of the finger hole to receive the replacement insert.

Returning now to FIG. 2, the finger insert identified by reference number 22 is of a standard design, while the finger insert identified by reference number 20 is constructed according to teachings of the invention. In accordance with the invention, the finger insert 20 includes materials of at least two different colors arranged in layers 32, 34. In this design, the layers 32, 34 are concentric cylindrical annuluses. It will be appreciated, however, that the finger insert may be of any appropriate configuration, so long as both the primary and secondary layers 32, 34 are disposed at least along the wear surface of the inside of the finger hole 12. For example, the finger insert may have an annular structure, with the primary layer extending along only the portion of the finger which is disposed along the wear surface, as in an arc. Similarly, a finger insert having an annular structure might have an arcuate secondary layer extending along only the portion of the finger which is disposed along the wear surface. Alternately, the finger insert might have an arcuate shape which may be disposed along only the wear surface.

During use, the insert 20 is installed into the finger hole 12 of a bowling ball 10 by known methods. As the user's finger repeatedly moves against the inside surface of the finger insert 20 over an extended period of use of the ball 10 in bowling, the primary layer 32 is worn through and thereby exposes the differing color of the secondary layer 34. The finger insert 20 should be replaced when a sufficient amount of the color of the secondary layer is visible along the inside surface of the finger insert 20 to indicate that the insert 20 no longer provides it intended effect to a significant extent or degree.

Figure 5:
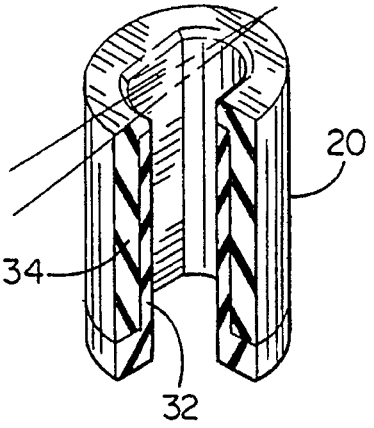
FIG. 5 is a perspective, sectioned view of a finger insert constructed in accordance with teachings of the invention.

The design and relationship between the particular layers 32, 34 of the finger insert 20 may vary, so long as the exposure of the layer or layers serves to alert the bowler of the appropriate time to replace the insert 20. For example, the layers 32, 34 may be as shown in FIG. 5. In this embodiment, both the primary and secondary layers 32, 34 have an "L-shaped" cross-section, the long legs of the "L" being disposed adjacent one another and the short legs of the "L" capping or cradling the end surfaces of the long legs.

Figure 6:
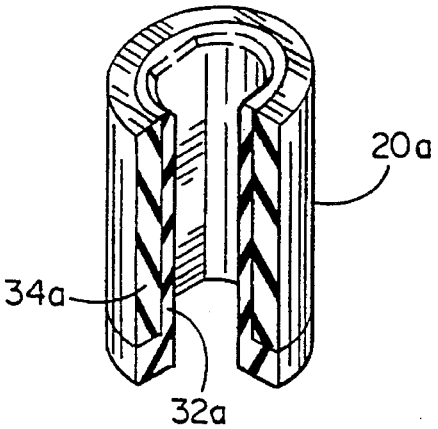
FIG. 6 is a perspective, sectioned view of an alternate embodiment of a finger insert constructed in accordance with teachings of the invention.

An alternate configuration of the finger insert 20*a* is shown in FIG. 6. In this embodiment, the primary layer 32*a* has an "L-shaped" cross-section, while the secondary layer 34*a* has a rectangular shape which is disposed concentrically about the long leg of the primary layer 32*a*. It will be appreciated that other alternative constructions are possible, so long as the primary and secondary layers extend along at least that portion of the finger insert against which the user's finger causes wear.

Moreover, the layers 32, 34 may be molded to any appropriate thickness. A primary layer 32 with a thickness on the order 0.030 to 0.060 inches has been found to adequately approximate the useful life of a bowling ball finger insert. In order to reduce the urgency of replacing the insert, it is currently preferred that the primary layer 32 be on the order of 0.030 inches thick. In this way, once the color of the secondary layer becomes visible, the user has a window of opportunity for replacing the insert prior to the finger insert 20 becoming useless.

Similarly, the layers 32, 34 of the finger insert 20 may be constructed of any desired colors, so long as the colors are sufficiently contrasting with one another that the user can easily identify when the insert is worn out. Further, different colors may be used to identify different features of the inserts, such as different sizes or different durometers of insert material.

The finger insert 20 is constructed by either molding the layers 32, 34 separately and then post-bonding the layers together, or sequentially molding the layers 32, 34. According to the currently preferred method, the primary layer 32 is first molded. The molded primary layer 32 is then loaded into a cavity of a standard finger insert mold. The secondary layer 34 is then post-molded or over-molded about the primary layer. It will be appreciated that this method of fabricating the finger insert 20 obviates the need to post-bond the separately molded layers together.

The finger insert may be constructed of any appropriate materials. The material that is currently preferred for molding the primary layer is a non-utility grade, FDA-approved polyvinylchloride, or PVC. This type of PVC is contains no chemical toxins. When the primary layer 32 is constructed with this type of PVC, it has a hardness on the order of 40D±4D. As a result, the PVC of the primary layer provides a comfortable feel against the bowler's finger. Moreover, inasmuch as this PVC is white in color, it is particularly useful in molding the primary layer 32 of the inventive finger insert 20 because there is a significant contrast when paired with a secondary layer 34 of a darker color.

Preferably, an additive such as Microban is added to the PVC of the primary layer 32. Microban contains a chemical that attacks bacteria, which can cause mildew in a finger insert. Accordingly, such an additive helps to prevent deterioration of the finger insert 20. It has additionally been determined that addition of Microban to the PVC of the primary layer 32 also enhances adhesion of the post-molded secondary layer 34 to the primary layer 32.

The secondary layer 34 is preferably formed of a utility grade PVC. As a result, the PVC of the secondary layer 34 is less costly than the PVC of the primary layer 32. The utility grade PVC of the secondary layer 34 typically has a range of hardness on the order of 47D±4D.

In summary, the inventive bowling ball finger insert provides means for readily identifying the useful life of the insert. The insert is relatively inexpensive, easy to manufacture, and requires no special equipment for installation or replacement. Moreover, the insert is versatile in that it can be manufactured in a variety of hardnesses, colors and designs.

We claim as our invention:

1. A bowling ball insert arcuate in shape for installation as a wear surface in the finger hole of a bowling ball, the insert being a composite structure formed of polymeric material and comprising a primary layer of wearable material of a first color and a secondary layer of a second color, the first color contrasting with the second color, the primary layer disposed to be exposed to contact by the bowler's finger and overlaying the secondary layer when the insert is installed in the finger hole of the bowling ball such that the primary layer wears away as a result of repeated bowls whereby the contrasting second color of the secondary layer becomes visible and thereby visually indicates the level of wear.

2. The bowling ball insert as claimed in claim 1 wherein the bowling ball insert has a hollow cylindrical shape, and the primary and secondary layers have hollow cylindrical shapes and are concentrically disposed with the secondary layer in surrounding contiguous relation to the primary layer.

3. The bowling ball insert as claimed in claim 1 wherein the bowling ball insert has a hollow cylindrical shape, and the primary layer has an arcuate shape and extends along only a portion of the bowling ball insert.

4. The bowling ball insert as claimed in claim 1 wherein the bowling ball insert has a hollow cylindrical shape, and the secondary layer has an arcuate shape and extends along only a portion of the bowling ball insert.

5. The bowling ball insert as claimed in claim 1 wherein the primary layer has a thickness substantially within the range of 0.030–0.060 inches.

6. The bowling ball insert as claimed in claim 2 wherein the primary layer is premolded and the secondary layer is post-molded about the primary layer.

7. The bowling ball insert as claimed in claim 1 wherein the secondary layer is premolded and the primary layer is post-molded to the secondary layer.

8. The bowling ball insert as claimed in claim 1 wherein the primary and secondary layers are separately molded and then post-bonded to form the bowling ball insert.

9. The bowling ball insert as claimed in claim 1 wherein the primary layer has an L-shaped cross-section.

10. The bowling ball insert as claimed in claim 9 wherein the secondary layer also has an L-shaped cross-section.

11. The bowling ball insert as claimed in claim 1 wherein the secondary layer has an L-shaped cross-section.

12. The bowling ball insert as claimed in claim 1 wherein the primary layer is formed of an FDA-approved polyvinylchloride.

13. The bowling ball insert as claimed in claim 12 wherein the primary layer has a hardness on the order of 40D.

14. The bowling ball insert as claimed in claim 12 wherein the primary layer comprises an additive which enhances adhesion between the primary and secondary layers.

15. The bowling ball insert as claimed in claim 1 wherein the secondary layer is formed of an utility-grade polyvinylchloride.

16. The bowling ball insert as claimed in claim 15 wherein the secondary layer has a hardness on the order of 47D.

17. The bowling ball insert as claimed in claim 15 wherein the secondary layer comprises an additive which enhances adhesion between the primary and secondary layers.

18. A bowling ball insert arcuate in shape for installation as a wear surface in the finger hole of a bowling ball, the insert being of a hollow cylindrical shape and comprising a hollow cylindrical primary layer of a non-utility grade FDA-approved polyvinylchloride which contains no chemical toxins and is of a first color and a hollow cylindrical secondary layer of an utility-grade polyvinyl chloride of a second color, the primary layer having an exposed inner cylindrical surface, the secondary layer surrounding and bonded with said primary layer, and the first color contrasting with the second color, whereby the inner surface of the primary layer is exposed to contact by the bowler's finger when the insert is installed in the finger hole of the bowling ball such that the primary layer wears away as a result of repeated bowls so that the contrasting second color of the secondary layer becomes visible thereby visually indicating the level of wear of the insert.

19. A bowling ball insert arcuate in shape for installation as a wear surface in a finger hole of a bowling ball, the bowling ball insert being formed by the following process:

molding a first layer of a polymer of a first color, post-molding a second layer of a polymer of a second color adjacent the first layer to form the bowling ball insert, the second color of the second layer contrasting with the first color of the first layer, such that as the one of the layers wears, the color of the other layer becomes visible to visually indicate wear.

20. The bowling ball insert as claimed in claim 19 wherein the first layer is molded in a first mold, and the molded first layer is then inserted into a second mold and the second layer is post-molded adjacent the first layer.

* * * * *